US009267404B2

(12) United States Patent
Shin

(10) Patent No.: US 9,267,404 B2
(45) Date of Patent: Feb. 23, 2016

(54) BLOW-BY GAS RECIRCULATING SYSTEM FOR INTERNAL COMBUSTION ENGINE

(71) Applicant: Hyundai Motor Company, Seoul (KR)

(72) Inventor: Dong Heun Shin, Whasung-si (KR)

(73) Assignee: Hyundai Motor Company, Seoul (KR)

( * ) Notice: Subject to any disclaimer, the term of this patent is extended or adjusted under 35 U.S.C. 154(b) by 84 days.

(21) Appl. No.: 14/098,410

(22) Filed: Dec. 5, 2013

(65) Prior Publication Data

US 2014/0290241 A1 Oct. 2, 2014

(30) Foreign Application Priority Data

Mar. 27, 2013 (KR) ..... 10-2013-0032948

(51) Int. Cl.
*F02M 25/07* (2006.01)
*F01M 13/02* (2006.01)

(52) U.S. Cl.
CPC ..... *F01M 13/028* (2013.01)

(58) Field of Classification Search
CPC ..... F01M 13/00; F01M 2013/0028; F01M 2013/0083; F01M 2013/027; F01M 2013/0411; F01M 13/02
USPC ..... 123/572–574
See application file for complete search history.

(56) References Cited

U.S. PATENT DOCUMENTS

| | | | | |
|---|---|---|---|---|
| 8,695,339 | B2 * | 4/2014 | Spix | 60/605.1 |
| 2001/0022175 | A1 * | 9/2001 | Moren | 123/572 |
| 2008/0295814 | A1 * | 12/2008 | Breuninger et al. | 123/572 |
| 2009/0090337 | A1 * | 4/2009 | Asanuma et al. | 123/574 |
| 2009/0308364 | A1 * | 12/2009 | Konohara | 123/572 |
| 2011/0073082 | A1 * | 3/2011 | Hattori et al. | 123/574 |
| 2011/0197864 | A1 * | 8/2011 | Karcher | 123/574 |
| 2012/0006306 | A1 * | 1/2012 | Boehm et al. | 123/572 |
| 2013/0213369 | A1 * | 8/2013 | Doko et al. | 123/574 |

FOREIGN PATENT DOCUMENTS

| | | | |
|---|---|---|---|
| JP | 6-212939 | A | 8/1994 |
| JP | 2010-163940 | A | 7/2010 |
| JP | 2012-87734 | A | 5/2012 |
| KR | 1020120013503 | A | 2/2012 |

* cited by examiner

*Primary Examiner* — Marguerite McMahon
(74) *Attorney, Agent, or Firm* — Morgan, Lewis & Bockius LLP

(57) ABSTRACT

A blow-by gas recirculating system for an internal combustion chamber, may include a cylinder including the combustion chamber, a ventilation passage that recirculates blow-by gas, which leaks from the combustion chamber, to the combustion chamber, a compressor that takes in and compresses outdoor air and supplies compressed air, and a supply passage that connects the compressor and the cylinder to mix the compressed air with the blow-by gas.

11 Claims, 1 Drawing Sheet

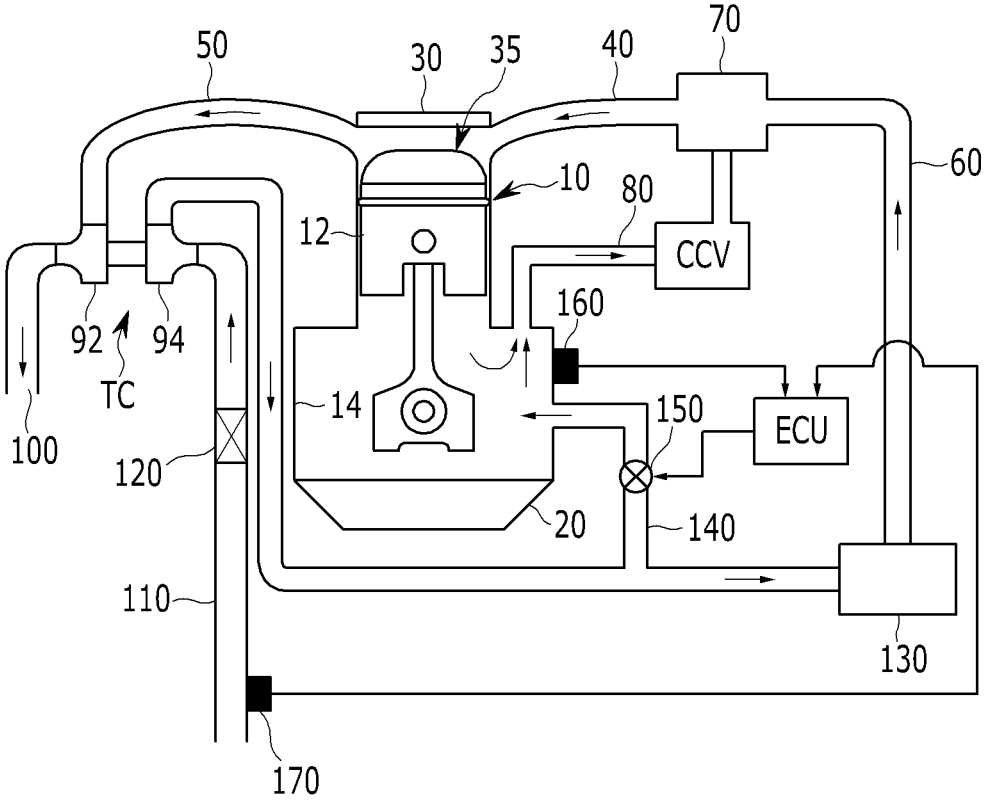
50
30
35
40
70
60
10
80
12
CCV
160
92
94
TC
100
14
150
ECU
120
20
140
110
130
170

BLOW-BY GAS RECIRCULATING SYSTEM FOR INTERNAL COMBUSTION ENGINE

CROSS-REFERENCE TO RELATED APPLICATION

The present application claims priority to Korean Patent Application No. 10-2013-0032948 filed on Mar. 27, 2013, the entire contents of which is incorporated herein for all purposes by this reference.

BACKGROUND OF THE INVENTION

1. Field of the Invention

The present invention relates to a blow-by gas recirculating system for an internal combustion engine, and more particularly, a blow-by gas recirculating system for an internal combustion engine that increases the temperature of blow-by gas by supplying high-temperature compressed air discharged from a compressor to an oil pan or a rocker cover.

2. Description of Related Art

In general, an internal combustion engine used as a power source in a vehicle, and the like includes a cylinder that forms a combustion chamber having a predetermined volume, a piston that reciprocates in the combustion chamber, a crank mechanism that switches the reciprocal motion of the piston to a rotational motion, a rocker cover (alternatively, a cylinder head cover) mounted on the top of the cylinder, and an oil pan that is mounted on the bottom of the cylinder and accommodates lubrication oil, and the like.

In the internal combustion engine, fuel and air flow into the combustion chamber, and then a mixture of the fuel and the air is compressed and exploded, and as a result, the piston performs the reciprocal motion and the reciprocal motion of the piston is switched to the rotational motion through the crank mechanism to generate rotational power required to drive the vehicle.

Some of uncombusted gas leak to the rocker cover or the oil pan in a compression stroke and some of combustion gas leak to the rocker cover or the oil pan in an expansion stroke while the internal combustion engine operates. Blow-by gas that leaks as above degrades the lubrication oil stored in the oil pan or corrodes an inner part of the internal combustion engine.

When the blow-by gas which is hazardous to the internal combustion engine is discharged to the atmosphere, air pollution is caused. Therefore, a blow-by gas recirculating system that draws out the blow-by gas from the internal combustion engine, which is recirculated and recombusted is applied to the internal combustion engine.

A blow-by gas recirculating system in the related art primarily uses closed crankcase ventilation (hereinafter, referred to as CCV) or positive crankcase ventilation (PCV), and such a system includes a ventilation passage for connecting the rocker cover or the oil pan with an intake system of the internal combustion engine, for example, a surge tank, thereby guiding the blow-by gas, which leaks to the rocker cover or the oil pan, to the intake system of the internal combustion engine through the ventilation passage.

The CCV includes a housing that incorporates a filter separating oil contained the blow-by gas, an inflow port that allows the blow-by gas, which leaks to a crankcase of the internal combustion engine, to flow into the housing, an exhaust port that allows the blow-by gas, which flows in through the inflow port, to be exhausted to the intake system of the internal combustion engine after oil is filtered through the filter, a drain port that allows the oil filtered through the filter to be drained to the oil pan, and the like.

However, when a vehicle adopting the blow-by gas recirculating system including the CCV in the related art is operated in a very cold weather place, a freezing phenomenon or slush is generated due to moisture contained in the blow-by gas, and the like by a lowoutdoor air temperature, and as a result, the blow-by gas may not be smoothly recirculated.

In order to reduce a concern about the occurrence of the freezing phenomenon or the slush, in some cases, the length of the blow-by gas passage is decreased, the diameter of the passage is increased, or an insulating material is used, but the methods are not effective.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a blow-by gas recirculating system for an internal combustion engine that allows the blow-by gas to be smoothly recirculated by preventing occurrence of a freezing phenomenon and slush of CCV due to excessive cooling of the blow-by gas, by appropriately increasing the temperature of the blow-by gas by supplying high-temperature compressed air discharged from a compressor of a turbo-charger to an oil pan or a rocker cover and mixing the supplied compressed air with the blow-by gas.

In an aspect of the present invention, a blow-by gas recirculating system for an internal combustion chamber, may include a cylinder including the combustion chamber, a ventilation passage that recirculates blow-by gas, which leaks from the combustion chamber, to the combustion chamber, a compressor that takes in and compresses outdoor air and supplies compressed air, and a supply passage that connects the compressor and the cylinder to mix the compressed air with the blow-by gas.

The cylinder is connected to a first intake passage that takes in the outdoor air, the compressor is connected with the cylinder through a second intake passage, and the supply passage is branched from the second intake passage to be connected with the cylinder.

The cylinder may include an oil pan that accommodates lubrication oil, and a rocker cover, and the supply passage connects the second intake passage to the top of the oil pan or the rocker cover.

An intercooler that is connected between the first intake passage and the second intake passage and configured to cool the compressed air, and the supply passage is connected to the first intake passage between the compressor and the intercooler.

A surge tank is mounted in the first intake passage, a crankcase is connected to the cylinder and the oil pan, and the ventilation passage connects the crankcase with the surge tank.

A turbine that rotates by using the pressure of exhaust gas discharged from the combustion chamber, wherein the compressor is connected coaxially with the turbine to be driven by the turbine.

The system may further include a turbine mounted in an exhaust passage of the combustion chamber and the first intake passage and rotating by using the pressure of exhaust gas discharged from the combustion chamber to suck the outdoor air into the first intake passage.

The system may further include a control valve that is installed in the supply passage to open and close the supply passage, and an electronic control unit that controls the control valve.

The system may further include a temperature sensor mounted to the first intake passage to sense a temperature of the outdoor air that is taken in through the compressor, wherein the electronic control unit controls the control valve through the pulse width modulation (PWM) control depending on the temperature of the outdoor air sensed by the temperature sensor.

The electronic control unit controls the control valve when the temperature of the outdoor air is equal to or lower than −25° C. or equal to or lower than a predetermined temperature.

The control valve may include a solenoid valve.

The system may further include a pressure sensor that senses internal pressure of the crankcase, wherein the electronic control unit controls the control valve through PWM control depending on the internal pressure of the crankcase.

The electronic control unit controls a replacement cycle of the lubrication oil accommodated in the oil pan by the PWM control of the control valve.

According to the exemplary embodiment of the present invention, a blow-by gas recirculating system blows high-temperature clean compressed air discharged from a compressor of a turbo-charger to an oil pan or a rocker cover to be mixed with blow-by gas, and as a result, when a vehicle is operated in a very cold weather place by increasing the temperature of the blow-by gas, it is possible to effectively reduce a concern that CCV will be frozen or slush will be generated due to a cold outdoor air temperature.

Further, the clean compressed air that is blown to the oil pan or the rocker cover captures contamination materials such as moisture or fuel particles that exist in the oil pan, or exhaust materials generated from a combustion chamber, and rapidly discharges the contamination materials to the CCV before the contamination materials are absorbed in lubrication oil of the oil pan, so as to prevent the lubrication oil from being contaminated by the contamination materials, thereby extending a replacement cycle and a use life-span of the lubrication oil.

The methods and apparatuses of the present invention have other features and advantages which will be apparent from or are set forth in more detail in the accompanying drawings, which are incorporated herein, and the following Detailed Description, which together serve to explain certain principles of the present invention.

BRIEF DESCRIPTION OF THE DRAWINGS

FIG. 1 is a configuration diagram of a blow-by gas recirculating system for an internal combustion engine according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the FIGURES, reference numbers refer to the same or equivalent parts of the present invention throughout the several FIGURES of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, an exemplary embodiment of the present invention will be described in detail with reference to the accompanying drawing.

An internal combustion engine includes a plurality of cylinders 10 each having a combustion chamber 35. An oil pan 20 accommodating lubrication oil is attached to the bottom of the cylinder 10 and a rocker cover 30 is mounted on the top of the cylinder 10.

Each of an intake manifold 40 that supplies outdoor air to the combustion chamber 35 and an exhaust manifold 50 that discharges exhaust gas generated by combustion of fuel in the combustion chamber from the combustion chamber is connected to the top of the cylinder 10.

A piston 12 is installed in the cylinder 10 to reciprocate in the combustion chamber.

A first first intake passage 60 that supplies the outdoor air is connected to the intake manifold 40 and a surge tank 70 is installed in the first intake passage 60.

A ventilation passage 80 is connected to a crankcase 14 covering the cylinder 10 in order to recirculate blow-by gas, which leaks from the combustion chamber of the cylinder 10, to the combustion chamber.

The ventilation passage 80 may connect the crankcase 14 and the surge tank 70 to each other.

A closed crankcase ventilation (CCV) is installed in the ventilation passage 80 in order to filter oil contained in the blow-by gas that is recirculated to the surge tank 70 through the ventilation passage 80.

The CCV filters oil particles contained in the blow-by gas and recirculates the filtered oil particles to the oil pan 20 and the blow-by gas from which the oil is filtered by the CCV is recirculated to the combustion chamber by passing through the surge tank 70 and the intake manifold 40 through the ventilation passage 80 and the intake manifold 40 through the ventilation passage 80.

The ventilation passage 80 may be connected to an appropriate portion of the first intake passage 60 in addition to the surge tank 70.

A turbo-charger (TC) is installed in order to use the pressure of the exhaust gas discharged through the exhaust manifold 50.

The turbo-charger (TC) may include a turbine 92 that rotates at discharge pressure of the exhaust gas and a compressor 94 that is connected coaxially with the turbine 92 to take in and compress the outdoor air while rotating by receiving rotational force of the turbine 92.

The exhaust gas that rotates the turbine 92 is discharged to the outside through an exhaust passage 100 connected to the turbine 92.

A second intake passage 110 for taking in the outdoor air is connected to the compressor 94.

An air cleaner 120 is installed in the second intake passage 110 in order to filter foreign materials contained in the outdoor air that is taken in through the second intake passage 110.

In order to supply the combustion chamber with compressed air which the compressor 94 compresses by taking in the outdoor air, the compressor 94 is connected with the first intake passage 60.

An intercooler 130 is installed in the first intake passage 60 in order to lower the temperature of the compressed air.

When the outdoor air is compressed by the compressor 94, the temperature of the outdoor air rises up to 70 to 200° C. and the pressure of the outdoor air rises up to approximately 2 bar.

A supply passage 140 is connected to the first intake passage 60 between the compressor 94 and the intercooler 130 in order to increase the temperature of the blow-by gas by using the temperature of high-temperature clean compressed air of which the foreign materials are filtered.

The supply passage 140 serves to connect the first intake passage 60 and the inside of the cylinder 10, particularly the top of the oil pan 20.

When the oil pan 20 and the rocker cover 30 are configured to communicate with each other, the supply passage 140 may connect the first intake passage 60 and the rocker cover 30 to each other.

A control valve 150 is installed in the supply passage 140 in order to control opening and closing of the supply passage 140.

The control valve 150 may be configured by a solenoid valve that opens and closes the supply passage 140 while being turned on or off depending on application of control current.

The control valve 150 is connected to an output terminal of an engine control unit or an electronic control unit (ECU) in order to control the control valve 150.

A pressure sensor 160, which senses internal pressure of the crankcase 14 to input a sensing signal, may be connected to an input terminal of the electronic control unit (ECU).

Further, a temperature sensor 170, which senses the temperature of the outdoor air, which is taken in through the second intake passage 110, to input a sensing signal, may be connected to the electronic control unit (ECU).

According to the exemplary embodiment of the present invention configured as above, when a vehicle travels, the electronic control unit (ECU) senses the temperature of the outdoor air that is taken in through the second intake passage 110 via the temperature sensor 170.

There is a high concern that the freezing phenomenon will occur in the CCV when the temperature of the outdoor air is equal to or lower than, for example, −25° C.

Therefore, the electronic control unit (ECU) applies a control signal to the control valve 150 to allow the supply passage 140 to be opened when the temperature of the outdoor air sensed via the temperature sensor 170 is equal to or lower than −25° C. or equal to or lower than a predetermined set value.

The electronic control unit (ECU) may control the control valve 150 by using pulse width modulation (PWM) control.

As a result, some of the high-temperature clean compressed air compressed in the turbine 94 is supplied to the oil pan 20 side through the supply passage 140.

The high-temperature compressed air supplied to the oil pan 20 side is mixed with the blow-by gas, which leaks into the crankcase, so as to increase the temperature of the blow-by gas.

That is, when the high-temperature compressed air at 70 to 200° C. is mixed with the blow-by gas at 30 to 40° C. when the temperature of the outdoor air is −35° C., thereby increasing the temperature of the blow-by gas to minimum 50° C. or more.

In addition, when the blow-by gas of which the temperature rises is supplied to the CCV as above, there is no concern that the CCV will be frozen by the blow-by gas even in the case where the temperature of the outdoor air is low.

Further, since the compressed air blown to the oil pan 20 side is rapidly circulated to the CCV side while being mixed with the blow-by gas, a possibility is reduced in which the lubrication oil accommodated in the oil pan 20 will be contaminated by the foreign materials contained in the blow-by gas.

Meanwhile, when the compressed air is supplied to the oil pan 20, the internal pressure of the crankcase 14 may be increased. Therefore, the electronic control unit (ECU) senses the internal pressure of the crankcase 14 via the pressure sensor 160 and judges whether the sensed pressure is more than predetermined allowable pressure, so as to appropriately control the supply of the compressed air through the supply passage 140.

That is, the electronic control unit (ECU) may control the supply of the compressed air by PWM-controlling the control valve 150.

In addition, when a replacement cycle of the lubrication oil needs to be controlled, the electronic control unit (ECU) may appropriately control the supply of the compressed air by PWM-controlling the control valve 150.

For convenience in explanation and accurate definition in the appended claims, the terms "upper", "lower", "inner" and "outer" are used to describe features of the exemplary embodiments with reference to the positions of such features as displayed in the FIGURES.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. They are not intended to be exhaustive or to limit the invention to the precise forms disclosed, and obviously many modifications and variations are possible in light of the above teachings as well as various alternatives and modifications thereof. It is intended that the scope of the invention be defined by the Claims appended hereto and their equivalents.

What is claimed is:

1. A blow-by gas recirculating system for an internal combustion chamber, comprising:

a cylinder including the combustion chamber;

a ventilation passage that recirculates blow-by gas, which leaks from the combustion chamber, to the combustion chamber;

a compressor that takes in and compresses outdoor air and supplies compressed air;

a supply passage that connects the compressor and the cylinder to mix the compressed air with the blow-by gas;

a control valve installed in the supply passage to open and close the supply passage;

an electronic control unit controlling the control valve; and a temperature sensor mounted to a first intake passage to sense a temperature of the outdoor air taken in through the compressor, wherein the electronic control unit controls the control valve through pulse width modulation (PWM) control depending on the temperature of the outdoor air sensed by the temperature sensor.

2. The system of claim 1, wherein:

the cylinder is connected to the first intake passage that takes in the outdoor air, the compressor is connected with the cylinder through a second intake passage, and the supply passage is branched from the second intake passage to be connected with the cylinder.

3. The system of claim 2, wherein:

the cylinder includes an oil pan that accommodates lubrication oil, and a rocker cover, and the supply passage connects the second intake passage to the top of the oil pan or the rocker cover.

4. The system of claim 3, wherein:

an intercooler that is configured to cool the compressed air is disposed in the second intake passage; and the supply passage is connected to the second intake passage between the compressor and the intercooler.

5. The system of claim 4, wherein:

a surge tank is mounted in the second intake passage, a crankcase is connected to the cylinder and the oil pan, and the ventilation passage connects the crankcase with the surge tank.

6. The system of claim 1, further comprising:

a turbine that rotates by using the pressure of exhaust gas discharged from the combustion chamber, wherein the compressor is connected coaxially with the turbine to be driven by the turbine.

7. The system of claim 2, further comprising:

a turbine mounted in an exhaust passage of the combustion chamber and the first intake passage and rotating by using the pressure of exhaust gas discharged from the combustion chamber to suck the outdoor air into the first intake passage.

8. The system of claim 1, wherein the electronic control unit controls the control valve when the temperature of the outdoor air is equal to or lower than −25° C. or equal to or lower than a predetermined temperature.

9. The system of claim 1, wherein the control valve includes a solenoid valve.

10. The system of claim 1, further comprising:

a pressure sensor that senses internal pressure of the crankcase, wherein the electronic control unit controls the control valve through PWM control depending on the internal pressure of the crankcase.

11. The system of claim 10, wherein the electronic control unit controls a replacement cycle of the lubrication oil accommodated in the oil pan by the PWM control of the control valve.

* * * * *